US008596636B2

(12) United States Patent
Ichikawa et al.

(10) Patent No.: US 8,596,636 B2
(45) Date of Patent: Dec. 3, 2013

(54) SHEET FEEDING UNIT AND IMAGE FORMING APPARATUS

(75) Inventors: Hiroshi Ichikawa, Okazaki (JP); Akira Terao, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 314 days.

(21) Appl. No.: 12/732,739

(22) Filed: Mar. 26, 2010

(65) Prior Publication Data

US 2011/0024968 A1 Feb. 3, 2011

(30) Foreign Application Priority Data

Jul. 31, 2009 (JP) ..... 2009-179218

(51) Int. Cl.
*B65H 5/00* (2006.01)

(52) U.S. Cl.
USPC ..... 271/10.13; 271/4.01; 271/4.04; 271/4.08; 271/4.1; 271/10.01; 271/10.04; 271/10.09; 271/10.11

(58) Field of Classification Search
USPC ..... 271/4.01, 4.04, 4.08, 4.1, 10.01, 10.04, 271/10.09, 10.11, 10.13
See application file for complete search history.

(56) References Cited

U.S. PATENT DOCUMENTS 5,423,526 A * 6/1995 Hasegawa ..... 271/10.13
5,480,132 A * 1/1996 Kiyohara et al. ..... 271/10.01
5,664,771 A * 9/1997 Nagatani et al. ..... 271/10.03
6,168,147 B1 * 1/2001 Nose et al. ..... 271/10.13
6,736,389 B2 * 5/2004 Kosmoski ..... 271/116
6,739,589 B2 * 5/2004 Hiramatsu ..... 271/184
6,824,131 B2 11/2004 Togashi
6,834,850 B2 * 12/2004 Fukuchi ..... 271/10.11
6,983,122 B2 * 1/2006 Hayamizu et al. ..... 399/405
7,793,933 B2 * 9/2010 Morimoto et al. ..... 271/264
7,971,867 B2 * 7/2011 Shiraiwa et al. ..... 271/10.01
8,028,986 B2 * 10/2011 Koga et al. ..... 271/10.01

(Continued)

FOREIGN PATENT DOCUMENTS

CN 1577130 A 2/2005
JP 08-012105 1/1996

(Continued)

OTHER PUBLICATIONS

JP Office Action mailed May 10, 2011, JP Appln. 2009-179218, English translation.

(Continued)

*Primary Examiner* — Prasad Gokhale
(74) *Attorney, Agent, or Firm* — Banner & Witcoff, Ltd.

(57) ABSTRACT

A sheet feeding unit having a holding section; a separation pad that contacts a sheet and imparts a conveyance resistance to the sheet; a separation roller that imparts a conveyance force to the sheet; a drive source that supplies driving force to the separation roller; a conveyance roller disposed at a position downstream of the separation roller, wherein the conveyance roller rotates at a circumferential speed greater than a circumferential speed of the separation roller, to impart conveyance force to the sheet, and wherein the conveyance roller and the separation roller are disposed so as to simultaneously contact the same sheet; and a drive shutoff unit, which shuts off the driving force supplied to the separation roller when the conveyance roller imparts the conveyance force to the sheet so the separation roller rotates in a following manner with the conveyance of the sheet.

13 Claims, 5 Drawing Sheets

(56) References Cited

U.S. PATENT DOCUMENTS

| | | | | |
|---|---|---|---|---|
| 2002/0036377 | A1 | 3/2002 | Togashi | |
| 2004/0108647 | A1 | 6/2004 | Iida | |
| 2005/0051944 | A1 | 3/2005 | Makino et al. | |
| 2006/0180987 | A1 | 8/2006 | Hattori | |
| 2006/0220297 | A1* | 10/2006 | Kusumi | 271/10.01 |
| 2009/0180822 | A1 | 7/2009 | Yano et al. | |
| 2009/0218751 | A1* | 9/2009 | Kutzer et al. | 271/10.01 |
| 2010/0156029 | A1* | 6/2010 | Kwak et al. | 271/10.13 |

FOREIGN PATENT DOCUMENTS

| | | | |
|---|---|---|---|
| JP | 10-194482 | | 7/1998 |
| JP | 11-139624 | A | 5/1999 |
| JP | 2002-302277 | A | 10/2002 |
| JP | 2003-026348 | A | 1/2003 |
| JP | 2003206042 | A | 7/2003 |
| JP | 2004-083226 | | 3/2004 |
| JP | 2006-016174 | A | 1/2006 |
| JP | 2006-096479 | | 4/2006 |
| JP | 2008-189448 | A | 8/2008 |
| JP | 2009-128667 | A | 6/2009 |

OTHER PUBLICATIONS

JP Office Action dated Aug. 2, 2011, corresponding JP Application No. 2009-179218; English Translation.

JP Office Action dated Oct. 11, 2011, corresponding Application No. JP 2009-179218, English Translation.

JP Report of Reexamination before Appeal mailed Mar. 27, 2012, JP Appln. 2009-179218, English translation.

JP Trial Decision Dissatisfaction 2011-27622 dated Oct. 9, 2012 JP Appln 2009-179218.

CN Office Action Nov. 1, 2012 CN App 201010155535.8.

* cited by examiner

SHEET FEEDING UNIT AND IMAGE FORMING APPARATUS

CROSS REFERENCE TO RELATED APPLICATION

The present application claims priority from Japanese Patent Application NO. 2009-179218, which was filed on Jul. 31, 2009, the disclosure of which is incorporated herein by reference in its entirety.

BACKGROUND

The present invention relates to a sheet feeding unit and an image forming apparatus using the sheet feeding unit.

In relation to a separation mechanism that separates sheets held in a stacked manner, to convey and feed the separated sheets one at a time, a related separation mechanism adopts a separation-pad-type separation mechanism comprises a separation pad that contacts a delivered sheet, thereby imparting predetermined conveyance resistance to the sheet, and a separation roller that rotates while pressing the sheet against the separation pad.

SUMMARY

Incidentally, in the separation mechanism of separation pad, sheets are separated one at a time by utilization of frictional force developing by a contact plane between a sheet and a separation pad. Therefore, it has empirically been known that, when conveyance speed of the sheet is increased, the frictional force developing by the contact plane between the sheet and the separation pad is decreased, which in turn deteriorates sheet separation capability and feeding capability.

For this reason, it is difficult to increase sheet feeding capability (sheet conveying speed) when the separation-pad-type separation mechanism is adopted. In a case where the sheet feeding capability is increased, a retard-type separation mechanism using a retard roller is adopted.

However, the retard-type separation mechanism is structurally more complicated than the separation-pad-type separation mechanism. Consequently, if the retard-type separation mechanism is adopted, an increase in manufacturing cost of a sheet feeder will be incurred.

Aspects of the present invention aim to enhancing sheet feeding capability (sheet conveying speed) while suppressing an increase in manufacturing cost of a sheet feeding unit by adopting a separation-pad-type separation mechanism.

An aspect of the present invention provides a sheet feeding unit for separating stacked sheets one at a time and conveying and feeding the separated sheets, the sheet feeding unit comprising: a holding section, which holds sheets; a separation pad that contacts a sheet sent from the holding section and imparts a predetermined conveyance resistance to the sheet; a separation roller that rotates while pressing the sheet against the separation pad and imparts a conveyance force to the sheet; a drive source that supplies driving force to the separation roller; a conveyance roller that is disposed at a position downstream of the separation roller with respect to the direction of conveyance, wherein the conveyance roller rotates at a circumferential speed greater than circumferential speed of the separation roller, to thus impart conveyance force to the sheet, and wherein the conveyance roller and the separation roller are disposed so as to simultaneously contact the same sheet; and a drive shutoff unit, which shuts off the driving force supplied to the separation roller when the conveyance roller imparts the conveyance force to the sheet, such that the separation roller rotates in a following manner with conveyance of the sheet.

DETAILED DESCRIPTION

Figure 1:
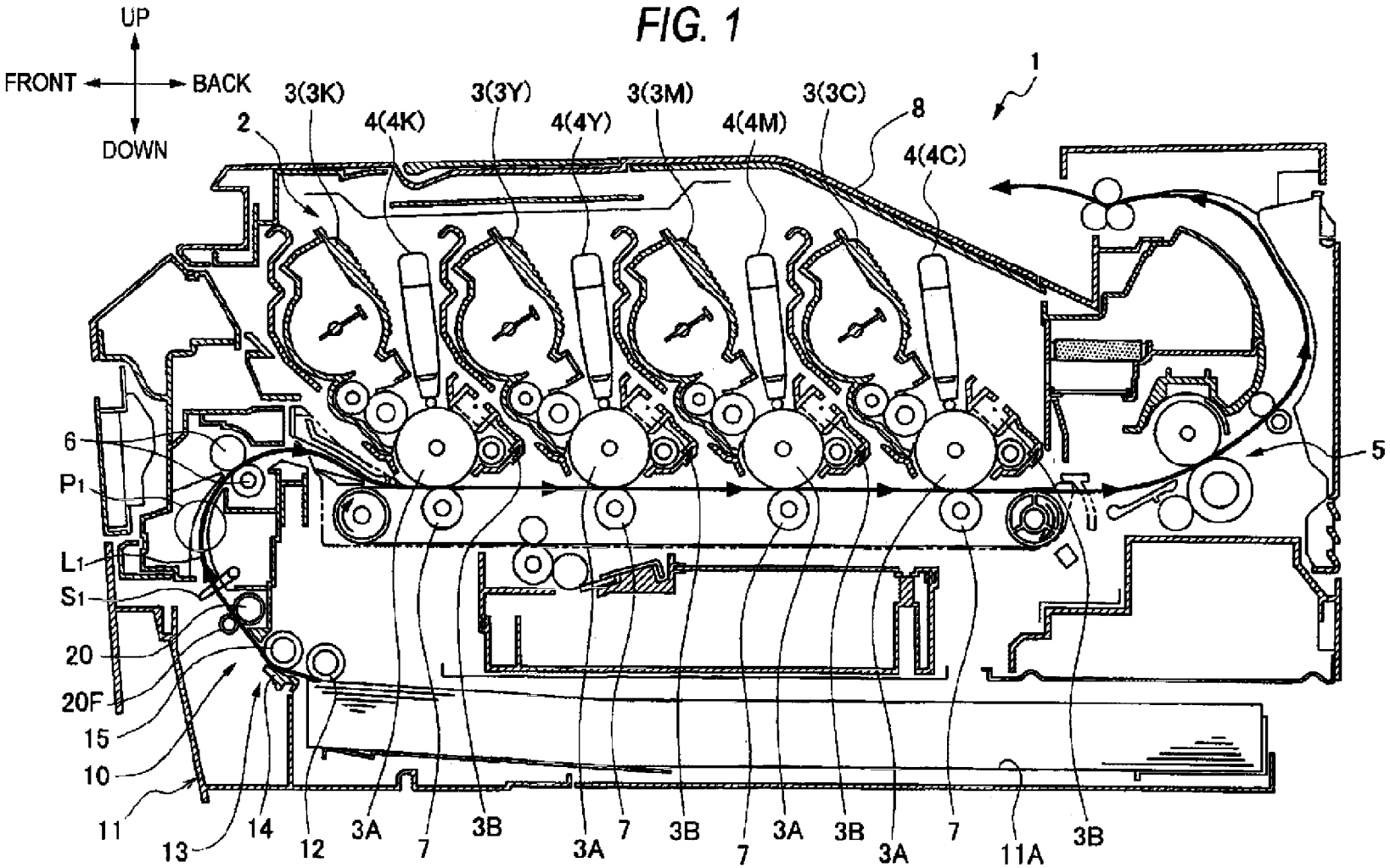
FIG. 1 is a diagrammatic view showing a center cross sectional view of an image forming apparatus according to illustrative aspects of the invention.

Aspects of the invention are directed toward an application of a sheet feeding unit of the present invention to a sheet feeding unit for use in an image forming apparatus. The aspects of the present invention are hereinbelow described by reference to the drawings.

Reference numerals in respective parentheses given to respective elements, and the like, are mere examples showing correlation between the aspects of the present invention and the specific elements, and the like, described in connection with aspects of the invention to be described later, and the present invention shall not be restricted to the specific elements, and the like, designated by the reference numerals in the parentheses given to the respective elements.

1. Schematic Configuration of the Image Forming Apparatus

As shown in FIG. 1, an image forming apparatus 1 is made up of an image forming section 2, and a sheet feeding unit 10, and the like. The image forming section 2 produces (prints) an image on a sheet, or an OHP sheet, or the like (hereinafter called a "sheet"). The sheet feeding unit 10 feeds a sheet to the image forming section 2.

The image forming section 2 according to the aspects of the invention is made up of an electrophotographic image forming unit comprises process cartridges 3, exposure units 4, fixing units 5, and the like. The image forming section 2 according to the aspects of the invention is of a direct tandem type in which a plurality of (four in this description) process cartridges 3K to 30 are provided for respective colors and are discretely arranged along a direction of conveyance of a sheet. In each of the process cartridges 3K to 3C developing agents of a plurality of types are transferred directly onto a sheet.

Each of the process cartridges 3K to 3C accommodates a photosensitive drum 3A carrying a developing agent, and an electrifier 3B for electrifying the photosensitive drum 3A, and the like. The exposure unit 4 comprises a plurality of LEDs aligned along an axial direction of the photosensitive drum 3A. In the present description, exposure units 4K to 4C are provided in correspondence with the respective process cartridges 3K to 3C.

The sheet carried out of the sheet feeding unit 10 toward the image forming section 2 is conveyed to the pair of registration rollers 6 provided at an entrance of the image forming section 2. After a skew of the sheet has been corrected by the pair of registration rollers 6, the sheet is conveyed to the photosensitive drum 3A.

The electrified photosensitive drum 3A is exposed by the exposure unit 4, whereby an electrostatic latent image is produced on a periphery of the drum. Subsequently, a developing agent (powdery toner in this description) is supplied to the photosensitive drum 3A, whereupon a developing agent image is carried (produced) on the periphery of the photosensitive drum 3A.

Since an electric charge having a polarity opposite to the polarity of the developing agent has already been applied to a transfer roller 7 disposed opposite the photosensitive drum 3A with the thus-conveyed sheet sandwiched therebetween, the developing agent carried on the photosensitive drum 3A is transferred onto the sheet.

Subsequently, the developing agent transferred onto the sheet is heated by the fixing unit 5, to thus be affixed to the sheet. After the sheet finishes undergoing an image forming operation, the direction of conveyance of the sheet is turned to an upward direction. The sheet is then output to a sheet output tray S disposed on an upper end face side of the image forming apparatus 1.

2. Detailed Structure of the Sheet Feeding Unit

As shown in FIG. 1, the sheet feeding unit 10 is a unit that separates, one at a time, sheets situated at an end in a stacked direction (i.e., the topmost position along the vertical direction in this description) from a plurality of stacked sheets held at a holding section 11A of a sheet feeding tray 11. Further, the sheet feeding unit 10 conveys and feeds the thus-separated sheet toward the image forming section 2. The sheet feeding tray 11 is removably attached to a main unit (a main frame and a housing) into which the image forming section 2, and the like, is assembled.

A pickup roller 12 contacts, sheets situated at the topmost end in the holding section 11A, while rotating, thereby sending the sheets. A separation-pad-type separation mechanism 13 separates the plurality of sheets sent by the pickup roller 12 and feeds the thus-separated sheets to the pair of registration rollers 6, which are provided at a downstream position with respect to the pickup roller 12 in the direction of conveyance.

The separation mechanism 13 comprises a separation pad 14 that contacts the sheet sent by the pickup roller 12, thereby imparting a given conveyance resistance to the sheet, and a separation roller 15 that rotates while pressing the sheet against the separation pad 14, thereby giving conveying force to the sheet.

In the present description, the separation roller 15 and the pickup roller 12 contact the sheet from the same side. Meanwhile, the separation pad 14 contacts the sheet from a side opposite to the separation roller 15 (i.e., an image formation side in this description).

The separation roller 15 rotates upon receipt of a driving force from a drive shaft 15A (see FIG. 2) extending from one end to the other end of the sheet feeding unit 10 (the sheet feeding tray 11) along its widthwise direction. Specifically, the widthwise direction of the sheet feeding unit 10 refers to a direction orthogonal to the direction of conveyance of a sheet and a thicknesswise direction of a sheet. In the description, the widthwise direction coincides with a right-left direction of the image forming apparatus 1.

Figure 2:
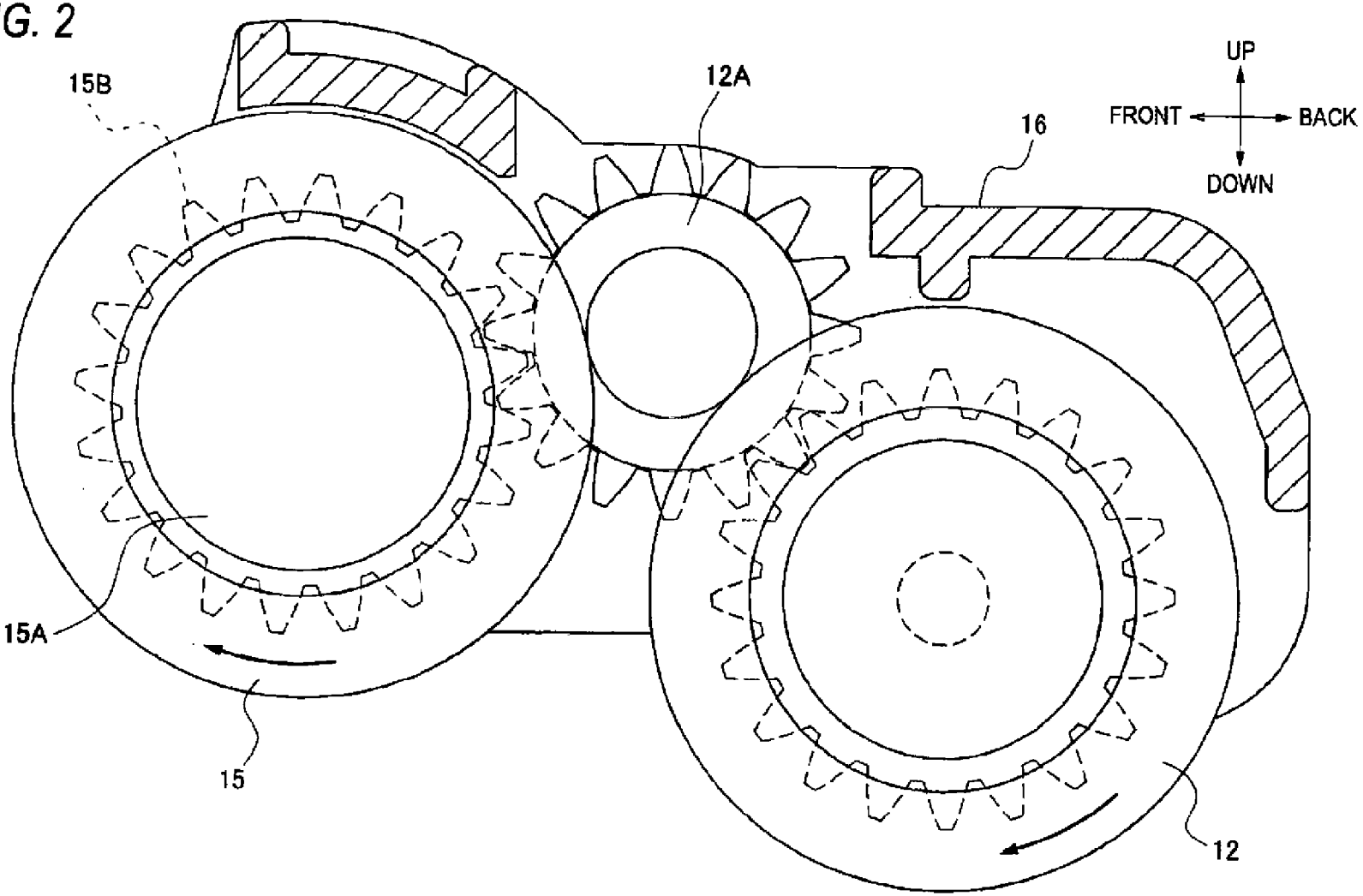
FIG. 2 is an enlarged view of a pickup roller in the image forming apparatus according to illustrative aspects of the invention.

As shown in FIG. 2, the pickup roller 12 is imparted with a driving force by way of an intermediate gear 12A that meshes with the drive shaft 15A or a gear section 15B provided on the separation roller 15, to thus rotate. Further, the pickup roller 12 is also rotatably supported by a roller holder 16 that is assembled to the drive shaft 15A in a swayable fashion.

Figure 3:
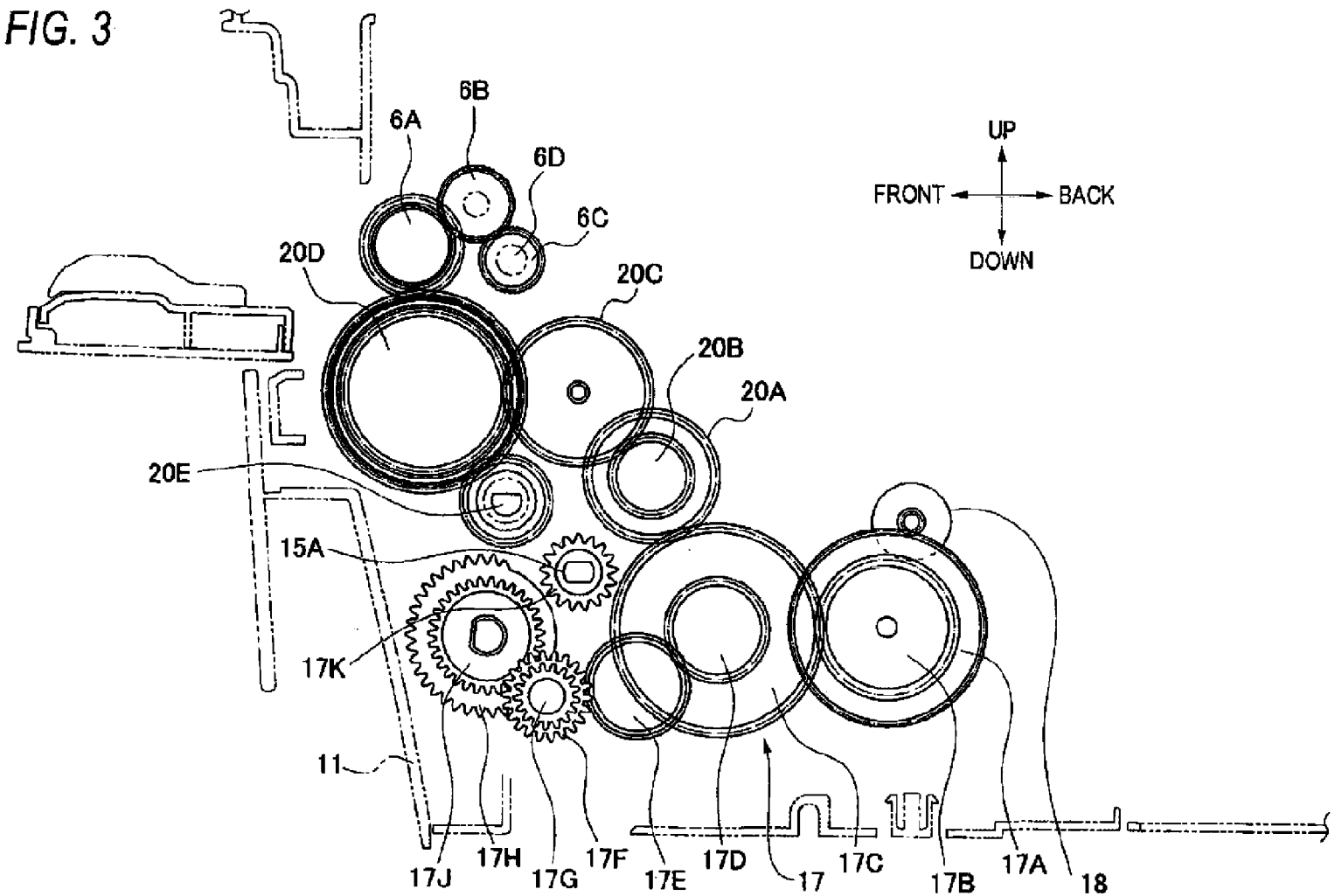
FIG. 3 is a view showing a gear train making up a power transmission path in the image forming apparatus according to illustrative aspects of the invention.

As shown in FIG. 3, the drive shaft 15A, which supplies driving force to the separation roller 15, is supplied with driving force from an electric motor 18, which makes up a drive source, by way of a gear train (a deceleration mechanism) 17 comprises a plurality of gears 17A to 17K.

Moreover, a one-way clutch mechanism 19 (see FIG. 4) that permits transmission of driving force in only one direction is disposed in a power transmission path extending from the drive shaft 15A to the separation roller 15. The one-way clutch mechanism 19 according to the aspects of the invention permits transmission of power from the electric motor 18 to the separation roller 15 and blocks transmission of power from the separation roller 15 to the electric motor 18.

The one-way clutch mechanism 19 according to the aspects of the invention is structurally similar to a roller type one-way clutch mechanism. Specifically, as shown in FIG. 4, the one-way clutch mechanism 19 comprises an inner ring member 19A that rotates along with the drive shaft 15A; an outer ring member 19B that rotates along with the separation roller 15; and a planetary gear 19C that meshes with a gear formed along an interior of the outer ring member 19B.

The planetary gear 19C is movably accommodated in a space 19D (hereinafter called a "pocket") created between the outer ring member 19B and the inner ring member 19A. The pocket 19D is made by cutting out a periphery of the inner ring member 19A.

A portion of an interior wall surface of the pocket 19D located at an advancing side of the inner ring member 19A in its rotating direction is formed into a smooth circular-arc shape fitting an outer shape of the planetary gear 19C. In the meantime, a portion of the interior wall surface of the pocket located at a receding side of the inner ring member in its rotating direction is formed into a rectangular shape that engages with teeth of the planetary gear 19C.

Figure 4:
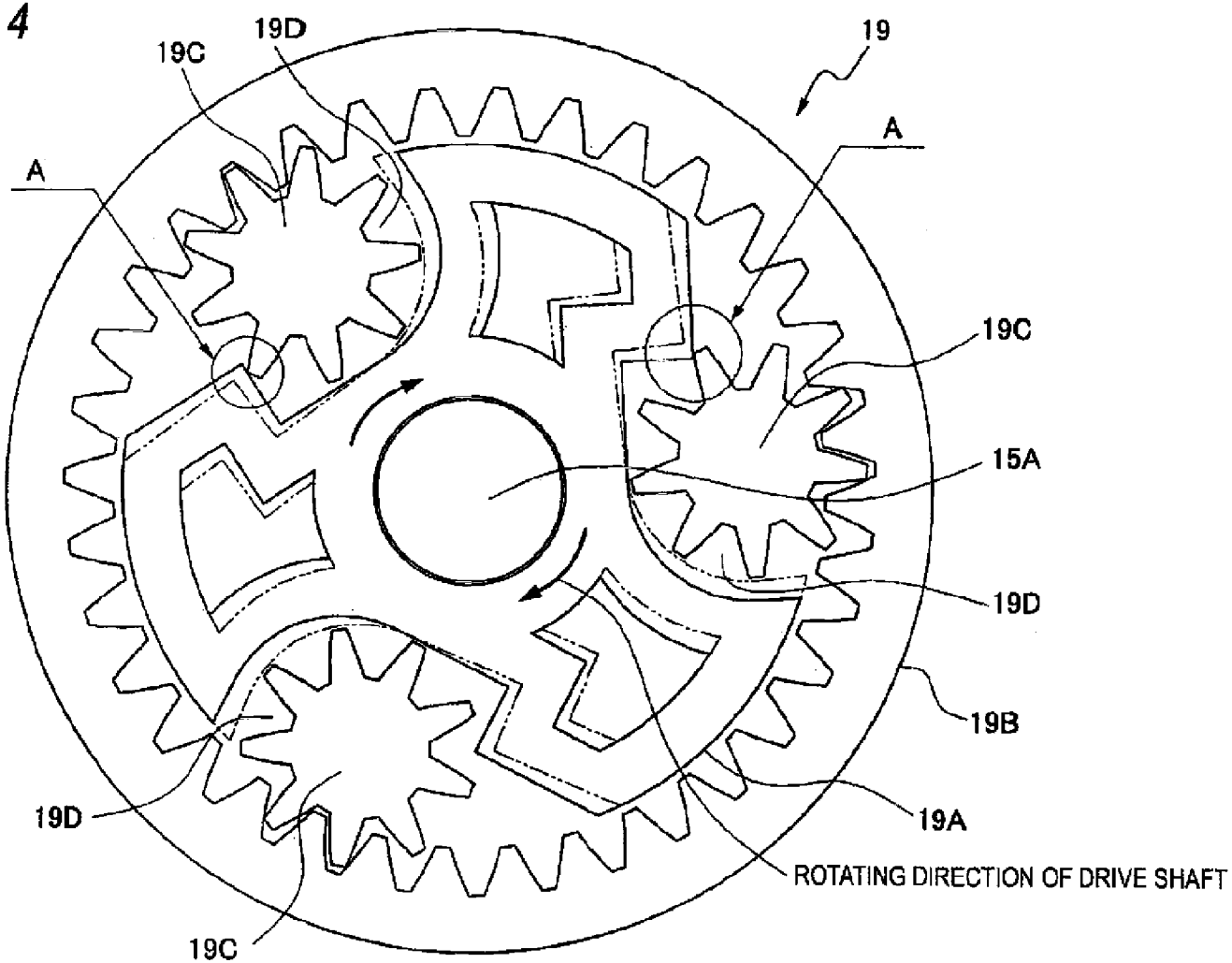
FIG. 4 is a structural view of a one-way clutch mechanism used in the image forming apparatus according to illustrative aspects of the invention.

Therefore, when the drive shaft 15A rotates and the inner ring member 19A shifts toward the advancing side with respect to the outer ring member 19B in the rotating direction, the interior wall surface of the pocket 19D located at its receding side in the rotating direction is engaged with the teeth of the planetary gear 19C (see particularly section A in FIG. 4), whereupon the planetary gear 19C becomes unable to rotate, as indicated by a solid line in FIG. 4. Therefore, the inner ring member 19A (the drive shaft 15A) and the outer ring member 19B (the separation roller 15) rotate in an integrated fashion, whereby power is transmitted from the electric motor 18 toward the separation roller 15.

On the contrary, when the outer ring member 19B (the separation roller 15) is shifted toward the advancing side with respect to the inner ring member 19A in the rotating direction as a result of the separation roller 15 rotating at angular speed which is greater than that of the drive shaft 15A (the inner ring member 19A), the planetary gear 19C moves toward the advancing side of the pocket 19D in the rotating direction as indicated by a chain double-dashed line shown in FIG. 4, whereupon the planetary gear 19C is disengaged from the pocket 19D.

As a result, the planetary gear 19C becomes rotatable, so that the outer ring member 19B (the separation roller 15) also becomes rotatable with respect to the inner ring member 19A (the drive shaft 15A). Thus, power transmission from the separation roller 15 to the electric motor 18 is interrupted.

In the aspects of the invention, another one-way clutch mechanism, which operates in the same manner as the one-way clutch mechanism 19 discussed above, is also provided in a power transmission path from the drive shaft 15A (the separation roller 15) to the pickup roller 12.

As shown in FIG. 1, a conveyance roller 20, which rotates upon contact with the sheet output from the separation mechanism 13 (the separation roller 15), thereby imparting conveyance force to the sheet, is disposed at a downstream position with respect to the separation roller 15 in the direction of conveyance of a sheet. The conveyance roller 20 is imparted with driving force from the electric motor 18, which is the drive source of the separation roller 15, to thus rotate at a circumferential speed that is greater than that of the separation roller 15.

A pinch roller 20F contacts a sheet from the same side that the separation pad 14 contacts the sheet, to thus press the sheet against the conveyance roller 20. Further, the pinch roller 20F also doubles as paper powder removal roller that eliminates extraneous matters, such as paper powder adhering to a sheet.

As shown in FIG. 3, the driving force supplied from the electric motor 18 is diverted toward the conveyance roller 20 by a gear 17C. The power is transmitted to a drive shaft 20E of the conveyance roller 20 by way of a gear train (a deceleration mechanism) consisting of gears 20A to 20D. A speed reducing ratio of this gear train is made smaller than the speed reducing ratio of the gear train 17, thereby making the circumferential speed of the conveyance roller 20 greater than the circumferential speed of the separation roller 15.

Moreover, the driving force supplied from the electric motor 18 to the conveyance roller 20 is diverted by a gear 20D toward the registration roller 6, and the thus-diverted driving force is transmitted to a drive shaft 6D of the registration roller 6 by way of gears 6A to 6C. The circumferential speed of the registration roller 6 is set so as to become smaller than the circumferential speed of the conveyance roller 20 but greater than the circumferential speed of the separation roller 15.

Incidentally, as shown in FIG. 1, a conveyance path L1 extending from the separation roller 15 to the entrance of the image forming section 2 is set to a path that is bent into a U-shaped form so as to have a flexure point P1 at a downstream location with respect to the separation roller 15 in the direction of conveyance. The conveyance roller 20 is set in the U-shaped conveyance path L1 bent at a position upstream, in the direction of conveyance, with respect to the flexure point P1 and at a position where the conveyance roller and the separation roller 15 can simultaneously contact the same sheet.

Figure 5:
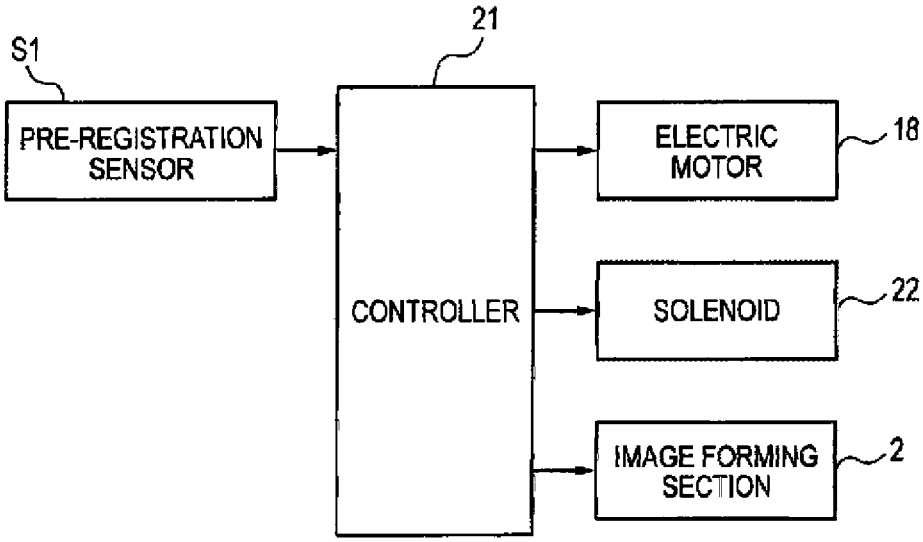
FIG. 5 is a block diagram of a control system in the image forming apparatus according to illustrative aspects of the invention.

A sheet sensor (hereinafter called a "pre-registration sensor") S1 for detecting presence/absence of a sheet is disposed at a position of the conveyance path L1 close to an exit of the conveyance roller 20. As shown in FIG. 5, a signal output from the pre-registration sensor S1 is input to a controller 21.

In accordance with a preset program, the controller 21 controls operations of the image forming section 2, the electric motor 18, the solenoid 22, and the like, upon receipt of a signal output from the pre-registration sensor S1, a print command from the user, and the like. As will be described later, the solenoid 22 comprises a clutch to connect or disconnect power transmission to the pickup roller 12 (the separation roller 15).

3. General Operation of the Sheet Feeding Apparatus

When the user issues a print command, the controller 21 rotates the electric motor 18 and feeds electric power to the solenoid 22, thereby bringing a gear 17H into engagement with a gear 17K. Thus, driving force generated by the electric motor 18 is transmitted to the drive shaft 15A, thereby rotating the pickup roller 12.

As shown in FIG. 3, teeth are not provided over an entire periphery of the gear 17H. The teeth of the gear 17H are provided in only a region where the pickup roller 12 rotates through at least a rotational angle that is necessary for a leading end of a sheet in the direction of the conveyance delivered from the holding section 11A to reach the pre-registration sensor S1 (the rotational angle is hereinbelow called a "sheet-feeding rotational angle").

Once the gear 17H and the gear 17K mesh each other as a result of power being fed to the solenoid 22, the power feed to the solenoid 22 is shut off. When the pickup roller 12 rotates through only the sheet-feeding rotational angle, the area of the outer periphery of the gear 17H, where teeth are not provided faces the gear 17K. Hence, the gears 17H and 17K are disengaged from each other, whereupon transmission of driving force to the pickup roller 12 (the drive shaft 15A) is shut off.

When a signal signifying presence of a sheet (the signal is hereinbelow called an "ON signal") is not output from the pre-registration sensor S1 within a predetermined period of time since electric power was fed to the solenoid 22, the controller 21 determines that the sheet feeding operation ended in failure and feeds electric power to the solenoid 22, thereby bringing the gear 17H and the gear 17K into engagement with each other to retry sheet feeding (the second sheet feeding operation is hereunder called a "retry").

Meanwhile, when the ON signal is output from the pre-registration sensor S1 within a predetermined period of time since electric power was fed to the solenoid 22, the controller 21 determines that the sheet feeding operation was successful and does not perform a retry operation.

When the ON signal was output from the pre-registration sensor S1, the gears 17H and 17K were already disengaged from each other and the sheet had experienced conveyance force from the conveyance roller 20. Therefore, the separation roller 15 rotates at an angular speed that is greater than the angular speed of the drive shaft 15A, whereby the outer ring member 19B shifts toward the advancing side with reference to the inner ring member 19A in the direction of rotation.

As mentioned previously, power transmission from the separation roller 15 to the electric motor 18 is shut off by the one-way clutch mechanism 19, whereby the separation roller 15 becomes freely rotatable. Therefore, the separation roller 15 rotates at the speed of conveyance of a sheet (i.e. the circumferential speed of the conveyance roller 20) in a following manner along with conveyance of the sheet.

4. Characteristics of the Image Forming Apparatus (Particularly a Sheet Feeding Unit) of the Aspects of the Invention In the aspects of the invention, when conveyance force is imparted to the sheet from the conveyance roller 20, the driving force supplied to the separation roller 15 is shut off, and the separation roller 15 becomes rotatable in a following manner along with conveyance of a sheet. Therefore, the sheet is conveyed at the circumferential speed of the separation roller 15 before of the conveyance roller 20 begins imparting a conveyance force (i.e. before the leading end of a sheet delivered from the separation roller 15 in the direction of conveyance contacts the conveyance roller 20).

When the leading end of the sheet in the direction of conveyance contacts the conveyance roller 20, the driving force supplied to the pickup roller 12 and the separation roller 15 is shut off, whereby the pickup roller 12 and the separation roller 15 become rotatable in a following manner along with conveyance of a sheet. Therefore, after the leading end of the sheet in the direction of conveyance has contacted the conveyance roller 20, the sheet is conveyed at the circumferential speed of the conveyance roller 20.

Therefore, even when the circumferential speed of the separation roller 15 is made comparatively slow so as to become suitable for the separation-pad-type separation mechanism 13, sheet feeding capability (sheet conveying speed) can be increased by making the circumferential speed of the conveyance roller 20 greater than the circumferential speed of the separation roller 15.

Therefore, when sheet feeding capability (sheet conveying capability) is set in a region surpassing separation capability of the separation mechanism 13 (which prevents occurrence of double sheet feeding, empty feeding, and the like) (i.e. when sheet feeding capability is set in a region that is not suitable for the separation-pad-type separation mechanism and that surpasses conveyance capability of comparatively-low speed), the speed of the separation roller 15 can be held at a low level. Therefore, sheets can be fed without problems while separation capability is maintained.

As mentioned above, in the aspects of the invention, it is possible to increase sheet feeding capability (sheet conveying speed) while avoiding an increase in manufacturing cost of the sheet feeding unit 10 by adopting the separation-pad-type separation mechanism.

Further, this description adopts a one-way clutch mechanism 19 as a drive shut off unit that shuts off the driving force supplied to the separation roller 15 when conveyance force is imparted to the sheet from the conveyance roller 20, thereby making the separation roller 15 able to rotate in a following manner along with conveyance of a sheet. When compared with, for instance, a case where drive shutoff unit is made up of an electrical configuration including a detection unit for detecting timing at which the conveyance roller 20 imparts conveyance force to a sheet, a solenoid that shuts off power transmission to the separation roller 15, and the like, the drive shutoff unit can be implemented inexpensively and reliably.

In this description, the conveyance roller 20 also rotates upon receipt of driving force from the electric motor 18 for driving the separation roller 15. Therefore, when compared with, for instance, a case where a drive source for supplying driving force to the separation roller 15 and a drive source for supplying driving force to the conveyance roller 20 are separately provided, manufacturing cost of the sheet feeding unit 10 can be curtailed.

Incidentally, the sheet is conveyed at the circumferential speed of the separation roller 15 before the leading end in the direction of conveyance of the sheet delivered by the separation roller 15 contacts the conveyance roller 20. Hence, the conveyance speed is lower than that achieved when the conveyance roller 20 conveys the sheet.

Conversely, in this description, the conveyance path L1 located downstream from the separation roller 15 in the direction of conveyance comprises a path that is bent into a U-shape so as to have the flexure point P1 at a downstream position with respect to the separation roller 15. Further, the conveyance roller 20 is placed at an upstream position in the direction of conveyance with respect to the flexure point P1 on the conveyance path M. In this description, the separation roller 15 and the conveyance roller 20 are arranged in close proximity to each other.

Therefore, the time during which the sheet is conveyed at the circumferential speed of the separation roller 15 becomes short, and the sheet delivered from the separation roller 15 is conveyed at the circumferential speed of the conveyance roller 20 at an early stage. Sheet feeding capability (sheet conveying speed) can therefore be increased.

In this description, the separation roller 15 also rotates during rotation of the pickup roller 12, and the separation roller 15 only rotates through a sheet-feeding rotational angle. If the separation roller 15 and the conveyance roller 20 are separated from each other, a time during which the separation roller 15 rotates while contacting the separation pad 14 during retry operation, or the like, will become longer.

Therefore, if a retry operation is continually performed when the separation roller 15 and the conveyance roller 20 are separated from each other, abrasion resulting from the separation roller 15 rubbing against the separation pad 14 quickly progresses. Therefore, the life of the separation roller 15 and the separation pad 14 may be shortened.

However, in this description, since the separation roller 15 and the conveyance roller 20 are arranged in close proximity to each other, the time during which the separation roller 15 rotates while contacting the separation pad 14 becomes shorter, thereby making it possible to prevent early abrasion of the separation roller 15 and shortening of the life of the separation roller 15.

It is desirable that the separation roller 15 and the conveyance roller 20 be situated as closely as possible. In this description, a center distance between the separation roller 15 and the conveyance roller 20 is made larger than a sum of a radial dimension of the separation roller 15 and a radial dimension of the conveyance roller 20 and is made smaller than triple (3 times) the radial dimension of the separation roller 15.

In this description, the circumferential speed of the registration roller 6 is made smaller than the circumferential speed of the conveyance roller 20. Hence, forcefully-pulled conveyance of a sheet toward a downstream side in the direction of conveyance, which would otherwise be caused when the image forming section 2 produces an image on a sheet, can be prevented. A color drift, which would otherwise arise during formation of an image, can also be prevented.

5. Correlation between Matters Identified as the Claimed Invention and the Aspects of the Invention In this description, the one-way clutch mechanism 19 is equivalent to the drive shutoff unit described in connection with claims, described in connection with the claims. Further, the process cartridges 3 are equivalent to image forming units described in connection with the claims.

(Other Aspects)

In the foregoing aspects of the invention, the drive shutoff unit comprises the one-way clutch mechanism 19. However, the present invention is not limited to the configuration. For instance, the drive shutoff unit can also comprise, for instance, a sprag-type one-way clutch mechanism, a slipper clutch mechanism that shuts off power transmission when rotational force transmitted from the separation roller 15 to the electric motor 18 reaches a predetermined level or more, or an electrical configuration.

In this description, the separation roller 15 and the conveyance roller 20 are driven by the single electric motor 18. However, the present invention is not limited to the configuration, and a drive source can also be provided separately for each of the rollers.

In this description, the conveyance path L1 located at a downstream position with respect to the separation roller 15 in the direction of conveyance is realized in the form of a path bent into a U-shape. However, the present invention is not limited to the configuration.

In this description, the sheet feeding unit of the present invention is applied to the image forming apparatus. However, the application of the present invention is not limited to the image forming apparatus, and the present invention can also be applied to, for instance, an automatic document feeder (ADF), or the like.

In this description, the sheet feeding unit is of type in which sheets stacked in the vertical direction are held in a substantially level position. However, the present invention is not limited to this sheet feeding unit. The direction along which sheets are stacked may also be tilted with reference to the vertical direction.

In this description, the exposure units 4 are of a type that include a plurality of LEDs aligned along an axial direction of the photosensitive drum 3A. However, the present invention is not limited to the configuration. The exposure units may also be of, for instance, a type that performs scanning by use of a laser beam.

In this description, the region where the teeth of the gear 17H are provided is determined such that the gears 17H and 17K are disengaged from each other when the pre-registration sensor S1 outputs the ON signal. However, the present invention is not limited to this configuration. For instance, in order to prevent the pickup roller 12 from causing a sheet feeding failure without fail, the region where the teeth of the gear 17H are provided may also be made greater than the sheet-feeding rotational angle.

When the region where the teeth are provided is made larger, the gears 17H and 17K still remain engaged with each other even when the pre-registration sensor S1 outputs the ON signal. However, the one-way clutch mechanism is provided in each of the power transmission paths for the pickup roller 12 and the separation roller 15, and therefore no problem will arise in sheet feeding even when the gears 17H and 17K remain engaged with each other.

The features of the present invention should be limited only by the description in the claims and should not be restricted to this description.

What is claimed is:

1. An image forming apparatus comprising:

a sheet feeding unit configured to separate stacked sheets one at a time and to convey and feed the separated sheets, the sheet feeding unit comprising:

a holding section configured to hold sheets;

a separation pad configured to contact a sheet sent from the holding section and impart a predetermined conveyance resistance to the sheet;

a separation roller that rotates while pressing the sheet against the separation pad and imparts a conveyance force to the sheet;

a drive source configured to supply driving force to the separation roller;

a conveyance roller that is disposed at a position downstream of the separation roller in a conveyance direction, wherein the conveyance roller rotates at a circumferential speed greater than a circumferential speed of the separation roller, to thus impart conveyance force to the sheet, and wherein the conveyance roller and the separation roller are disposed so as to simultaneously contact the same sheet; and a drive shutoff unit configured to shut off the driving force supplied to the separation roller when the conveyance roller imparts the conveyance force to the sheet, such that the separation roller rotates in a following manner with conveyance of the sheet; and an image forming section configured to produce images on the sheet conveyed from the sheet feeding unit, and a sheet entrance of the image forming section being provided with a registration roller disposed immediately before the image forming section in the conveyance direction and configured to correct a skew of the sheet fed from the sheet feeding unit, wherein a distance between the separation roller and the conveyance roller is smaller than a distance between the conveyance roller and the registration roller, and wherein a circumferential speed of the registration roller is smaller than the circumferential speed of the conveyance roller and larger than the circumferential speed of the separation roller.

2. The image formatting apparatus according to claim 1, wherein the drive shutoff unit is a one-way clutch mechanism that permits power transmission from the drive source to the separation roller, and the drive shutoff unit prevents power transmission from the separation roller to the drive source.

3. The image forming apparatus according to claim 1, wherein the drive source supplies the driving force to the conveyance roller.

4. The image forming apparatus according to claim 1, wherein a conveyance path is located downstream from the separation roller in the conveyance direction, and the conveyance path is bent into a U-shaped form having a flexure point located downstream of the separation roller in the conveyance direction, and the conveyance roller is disposed at a position upstream of the flexure point of the conveyance path in the conveyance direction.

5. The image forming apparatus according to claim 1, wherein the image forming section includes a plurality of image forming units respectively provided for different colors.

6. The image forming apparatus according to claim 1, wherein the image forming section is an electrophotographic device or has a photosensitive drum.

7. The image forming apparatus according to claim 1, wherein a distance between a center of the separation roller and a center of the conveyance roller is larger than a sum of a radial dimension of the separation roller and a radial dimension of the conveyance roller and is smaller than three times the radial dimension of the separation roller.

8. An image forming apparatus comprising:

a sheet feeding unit configured to separate stacked sheets one at a time and to convey and feed the separated sheets, the sheet feeding unit comprising:

holding means for holding sheets;

separation means for contacting a sheet sent from the holding means and imparting a predetermined conveyance resistance to the sheet;

a separation roller that rotates while pressing the sheet against the separation means and imparts a conveyance force to the sheet;

drive means for supplying driving force to the separation roller;

a conveyance roller that is disposed at a position downstream of the separation roller in a conveyance direction, wherein the conveyance roller rotates at a circumferential speed greater than a circumferential speed of the separation roller, to thus impart conveyance force to the sheet, and wherein the conveyance roller and the separation roller are disposed so as to simultaneously contact the same sheet; and drive shutoff means for shutting off the driving force supplied to the separation roller when the conveyance roller imparts the conveyance force to the sheet, such that the separation roller rotates in a following manner with conveyance of the sheet; and an image forming section configured to produce images on the sheet conveyed from the sheet feeding unit, a sheet entrance of the image forming section being provided with a registration roller disposed immediately before the image forming section in the conveyance direction and configured to correct a skew of the sheet fed from the sheet feeding unit, wherein a distance between the separation roller and the conveyance roller is smaller than a distance between the conveyance roller and the registration roller, and wherein a circumferential speed of the registration roller is smaller than the circumferential speed of the conveyance roller and larger than the circumferential speed of the separation roller.

9. The image forming apparatus according to claim 8, wherein the drive shutoff means is a one-way clutch mechanism that permits power transmission from the drive means to the separation roller, and the drive shutoff means prevents power transmission from the separation roller to the drive means.

10. The image forming apparatus according to claim 8, wherein the drive means supplies the driving force to the conveyance roller.

11. The image forming apparatus according to claim 8, wherein a conveyance path is located downstream from the separation roller in the conveyance direction, and the conveyance path is bent into a U-shaped form having a flexure point located downstream of the separation roller in the conveyance direction, and the conveyance roller is disposed at a position upstream of the flexure point of the conveyance path in the conveyance direction.

12. The image forming apparatus according to claim 8, wherein the image forming section is an electrophotographic device or has a photosensitive drum.

13. The image forming apparatus according to claim 8, wherein a distance between a center of the separation roller and a center of the conveyance roller is larger than a sum of a radial dimension of the separation roller and a radial dimension of the conveyance roller and is smaller than three times the radial dimension of the separation roller.

* * * * *